US005094489A

United States Patent [19]

Jones

[11] Patent Number: 5,094,489

[45] Date of Patent: Mar. 10, 1992

[54] SELF ATTACHING DOOR STRIKE PLATE

[75] Inventor: Jerald J. Jones, 269 Willow Ave., Hayward, Calif. 94543

[73] Assignee: Jerald J. Jones, Hayward, Calif.

[21] Appl. No.: 529,856

[22] Filed: May 29, 1990

[51] Int. Cl.[5] ..... E05C 21/02

[52] U.S. Cl. ..... 292/340; 292/DIG. 60; 292/DIG. 53

[58] Field of Search ..... 292/340, 346, DIG. 53, 292/341.18, 341.19, DIG. 60

[56] References Cited

U.S. PATENT DOCUMENTS

| | | | |
|---|---|---|---|
| D. 220,423 | 4/1971 | Dugan | D8/117 |
| 941,877 | 11/1909 | Hosch . | |
| 2,484,024 | 10/1949 | Garberding | 292/346 |
| 2,526,539 | 10/1950 | Carroll | 292/340 X |
| 2,668,074 | 2/1954 | Falk | 292/340 X |
| 2,790,663 | 4/1957 | Sarver | 292/340 X |
| 3,097,008 | 7/1963 | Gravelle | 292/346 |
| 3,244,443 | 4/1966 | Rodgers | 292/251.5 |
| 3,287,044 | 11/1966 | Ahlgren | 292/340 X |
| 3,418,018 | 12/1968 | Marburger et al. | 292/251.5 |
| 4,017,106 | 4/1977 | Salazar | 292/340 |
| 4,057,275 | 11/1977 | LaBeaud | 292/340 |

FOREIGN PATENT DOCUMENTS

| | | | |
|---|---|---|---|
| 3072 | 7/1931 | Australia | 292/346 |
| 17808 | of 1910 | United Kingdom | 292/346 |

*Primary Examiner*—Richard E. Moore

[57] ABSTRACT

A self attaching strike plate (20) with removable anchor teeth (34) for doors (46) with spring bolt latches (54). The anchor teeth (34) by repeatedly bending can be completely removed. Adaptable to a variety of door conditions including wood to metal door jambs (60). Easily installed and removed by tapping surface plate (22) and removed by prying off. Adhesive (44) may be substituted for screws (32).

3 Claims, 8 Drawing Sheets

SELF ATTACHING DOOR STRIKE PLATE

BACKGROUND—FIELD OF INVENTION

My invention relates generally to door latches and more particularly to strike plates of spring actuated locking latches.

BACKGROUND—DESCRIPTION OF PRIOR ART

In recent years there has been a constant increase in the costs of construction, remolding, repair, and building maintance. To offset the costs, home owners are doing the work themselves. Building owners are requiring the maintance people to do more of the specialty trades work. This has become popular and is a trend in the market evidenced by product lines of tools and How To Books for the Do It Yourself persons.

As always security is high on the list of priorities for the home owners and building owners. There is a large selection of entry door locks and security hardware available on the market.

I have a particular interest in the single unit strike plates that may or may not accompany entry knob sets. Here are some improved strike plates for security and adjustable;

U.S. Pat. No. 4,017,106 (1977) to Salazar, this strike plate is a single unit design for security purpose. It is inexpensive to make and simple to install on a variety of door conditions. Its design for installation can be improved upon by incorporating my removable preliminary self attaching anchor teeth to its design. Accuracy for latch bolt alignment would be easier to set and hold. Because of the ease of removal and reattaching, ease of adjusting is possible and thereby the use of horizontal elongated holes would be replaced with the conventional round screw holes. The anchor teeth on strike plates are intended to aid the installer.

U.S. Pat. No. 3,506,293 (1968) To Norris Industries. This is an adjustable two unit design consisting of a planar plate that attaches to the door jamb and the strike plate is movable that attaches directly to the planar plate with angeled elongated holes for the mounting screws into the planar plate. This unit would be more expensive. Extensive mortising would be necessary. However my simple one unit preliminary self attaching strike plate design results with more adjustments possible, simple to install and inexpensive to make and adaptable to a variety of door conditions.

U.S. Pat. No. 196,872 (1963) to Schlage. If an installer chose to use this combination strike and strike box, then mounting could be simplified and accuracy of latch bolt alignment held by incorporating the preliminary self attaching anchor teeth in the design.

U.S. Pat. No. 220,423 (1971) to Dugan. This is a safety keeper plate for security. To install this keeper plate without splitting and weakening the door jamb will require skill and alterations to the door jamb. This strike plate is not easily adjusted and will not fit a variety of door conditions.

KWIKSET Corp. Division of EMHART in Anaheim, Cal. Catalog No. SC-1-88 Col. These various designed strike plates and strike boxes are offered for a variety of door conditions. The installation of these are simple. Maintaining latch bolt hole alignment may not be as easy for a semi-skilled installer and having to adjust after finish mounting can be very frustrating. By incorporating my removable preliminary self attaching anchor teeth to the design, mounting and adjusting will be easier for the semi-skilled installer and faster for the skilled installer and still be adaptable to various door conditions.

The strike plates of prior art work well for their designed purposes, if THEY CAN BE INSTALLED CORRECTLY. Strike plate installations require the following:

1. Some physical and mechanical ability
2. Tools such as drills, chisels, screw drivers, router, and trisquare
3. Latch bolt alignment set and held Latch bolt alignment is a CRITICAL REQUIREMENT for all entry door locks. The strike plate latch bolt hole must align with the latch bolt. The latch bolt will engage through the opening of the strike plate bolt hole when door is in closed position. This is where the trial and error method comes into play for the semi-skilled installer of strike plates. Here is the frustration, once the installer has decided upon the permanent position of the strike plate, mounts the strike plate and then discovers it does not align with the latch bolt, then the installer has to remove and remount the strike plate. The problem encountered in moving the strike plate if you run the mounting screws too close to the original place, often the screw will cross over into the original hole pulling the strike plate back to the original position. All this reworking exposes the mortise and does not give a neat finish look.

I have not seen a strike plate with a built in aid for the installer to allow testing alignment of the latch bolt in the strike plate opening.

A need therefore exists for a simple, inexpensive way to hold a strike plate in position to test latch bolt alignment and be easily removed and repositioned on the door jamb.

OBJECTS and ADVANTAGES

It is therefore a major object of my invention to provide an improved and inexpensive strike plate that makes installations easier for the semi-skilled and faster for the skilled by a design that will:

A. Self attaching, no need to hold, frees one hand
B. Will stay in place to allow testing alignment of latch bolt to strike plate opening
C. Can be easily removed and repeatedly repositioned
D. Holds its place for final attachment and mounting with accompanying screws
E. One unit strike plate for lower manufacturer costs
F. Can be substituted for presently used strike plates without alterations to door jamb and supporting members
G. Readily adaptable to a variety of door sizes and types
H. Removable anchor teeth make it adaptable to metal door jambs
I. The option of incorporating an alternative for final mounting without mounting screws
J. Minute lateral adjustments are secure

BRIEF DESCRIPTION OF THE DRAWINGS

FIG. 8 is a side elevation view of a door jamb with my preferred embodiment as finish mounted there on.

FIG. 9 is a side elevation view of a door jamb with my preferred embodiment incorporating an alternative mounting design as finish mounted there on.

Referring now to the drawings FIGS. 1 thru 17 shows the parts of my improved strike plate in its perspective views and plan views. 20 designates my improved strike plate generally. The strike plate 20 is shown in FIGS. 6 and 15 to fully illustrate its removable preliminary self attaching parts called an anchor tooth 34 in proportion to its base plate 22.

Figure 1:
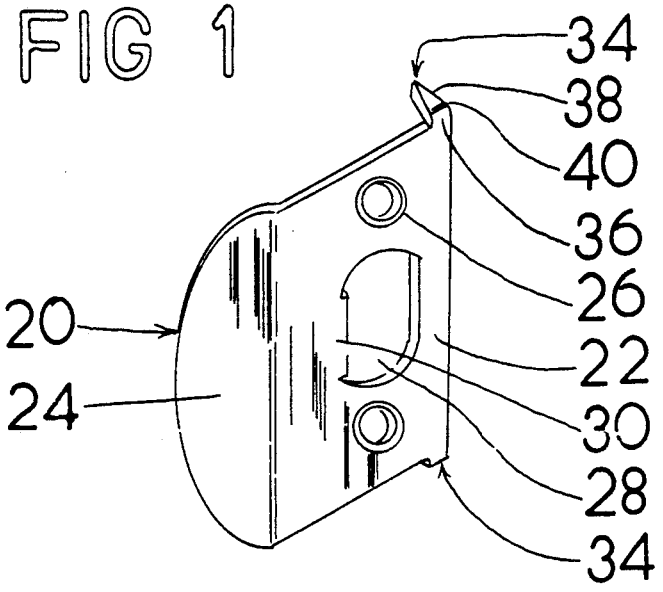
FIG. 1 is a perspective view of my preferred embodiment.
Figure 6:
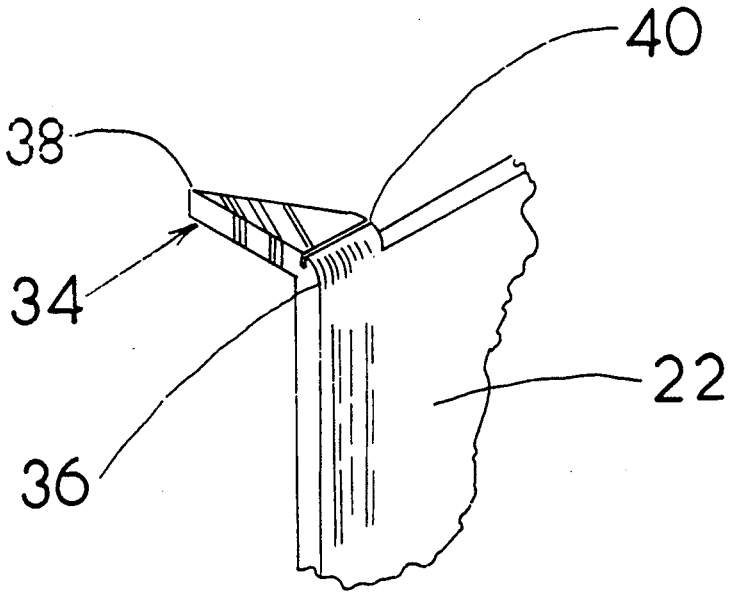
FIG. 6 is an enlarged perspective view of the anchor tooth.

The anchor tooth 34 is formed by extending the trailing edge to a given distance past the adjacent side. It stops and returns forming a point caused by the return angle and ends with its base 36 connecting the adjacent side this forming a tooth shaped anchor 34.

The anchor tooth 34 is bent perpendicular out of surface 22 alignment. In the surface outer bend of the anchor tooth base 36, there are laterally directed scores 40 which permit the anchor tooth 34 to be seperated into two parts, the proximal end base 36 and the distal portion 38 by repeatedly bending along 40 as hereafter explained.

Figure 15:
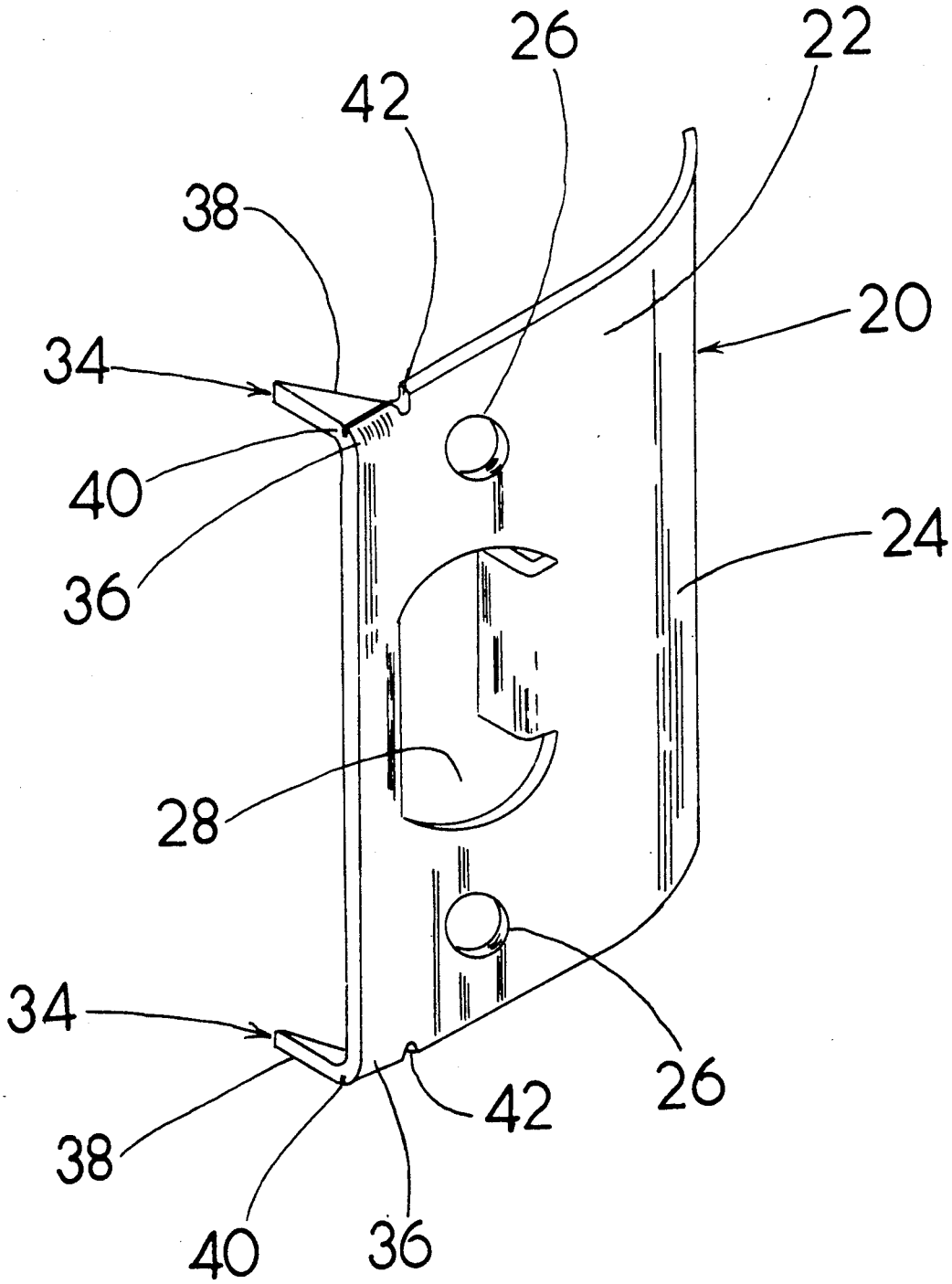
FIG. 15 is an enlarged perspective view of my preferred embodiment illustration of the relief notches at the base of the anchor teeth.

In FIG. 15 I have included relief slots 42 into the base surface 22 and adjacent to the base 36 of the anchor tooth 34. These relief slots 42 permit easy bending of the anchor tooth 34 out of surface alignment with the base plate surface 22 in accordance with known and accepted metal stamping practices.

Figure 13:
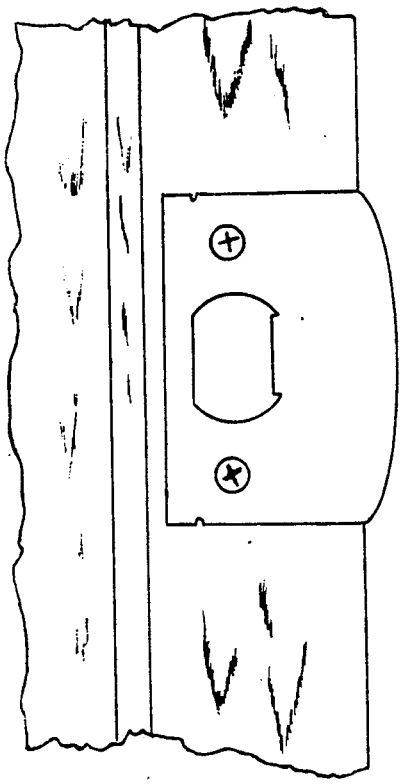
FIG. 13 is a side elevation view of my preferred embodiment finish mounted on a door jamb illustrating the relief notches at the base of the anchor teeth.

The relief slots 42 of FIG. 15 allow the anchor tooth to stay into edge alignment after it has been bent perpendicular from base surface 22. This edge alignment of FIG. 15 is illustrated in finish mounted in FIGS. 13 and 14.

FIGS. 1, 2, 3, 4, 5, and 6 DO NOT have relief slots 42 in their design. This is illustrated in FIGS. 8, 9, 11, 16, and 17.

Figure 7:
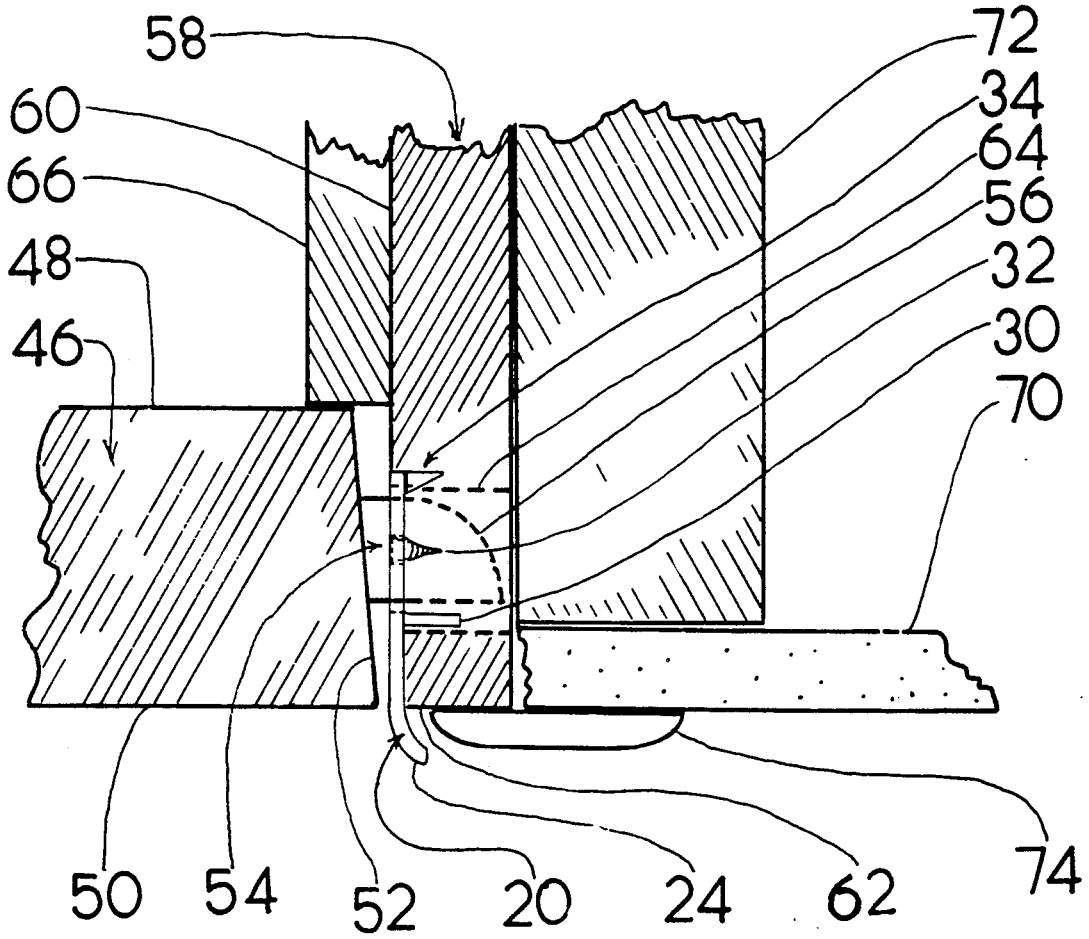
FIG. 7 is a top plan view of my preferred embodiment shown installed with a spring latch, door, and jamb being shown in cutaway.
Figure 10:
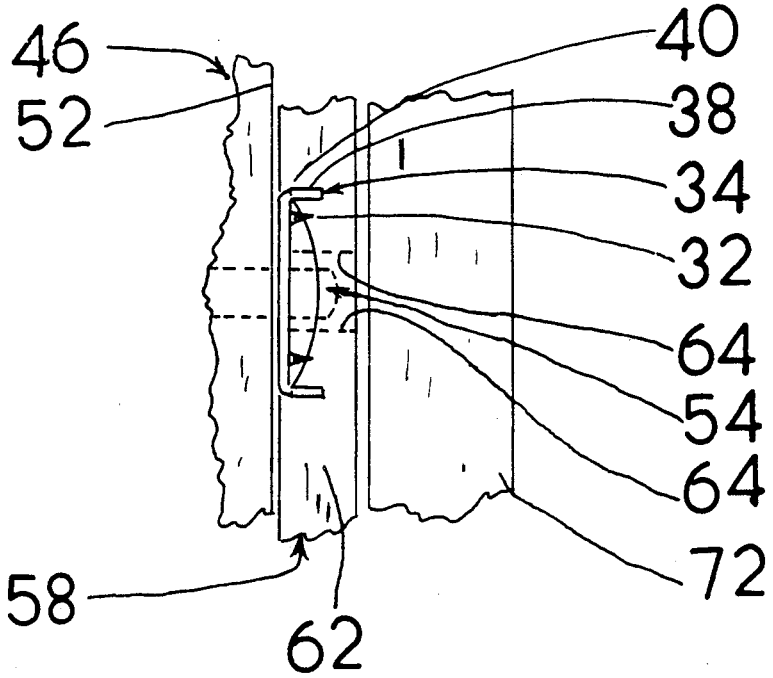
FIG. 10 is an end plan view of my preferred embodiment shown installed with a spring latch, door, and jamb being shown in the cutaway.
Figure 9:
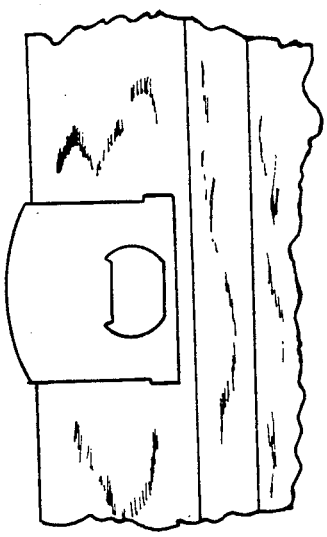

FIG. 1 strike plate 20 has a leading edge from the surface base 22 forming a lip 24 which is angularly offset to provide a cam surface for driving the spring loaded latch bolt 54 inwardly as the door 46 swings closed on FIGS. 7 and 10.

There is a latch bolt opening 28 for receiving the end of the latch bolt 54. A perpendicularly bent out of base surface 22 alignment is a tang 30 in FIG. 15. This is on the leading side of the latch bolt opening 28. This tang 30 protrudes into latch bolt hole 64 in door jamb 58 and provides an optional bearing surface for latch bolt 54 illustrated in FIGS. 7 and 10.

There are finish mounting screws 32 that fit through the screw holes 26 to secure to a door jamb 58. The screw mounted strike plate with relief slots 42 in FIG. 15 are finish mounted in FIG. 13

Figure 2:
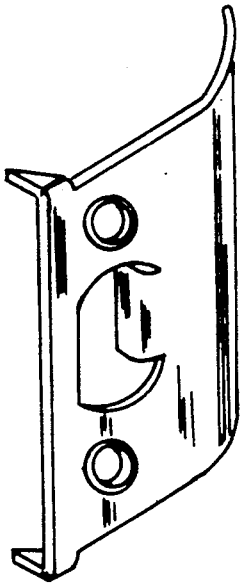
FIG. 2 is a second perspective view of my preferred embodiment.
Figure 4:
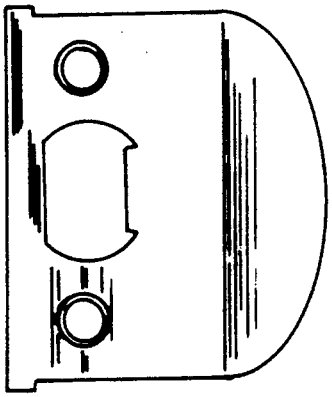
FIG. 4 is a side elevation view of my preferred embodiment.
Figure 5:
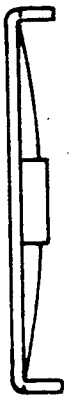
FIG. 5 is an end view of my preferred embodiment.
Figure 8:
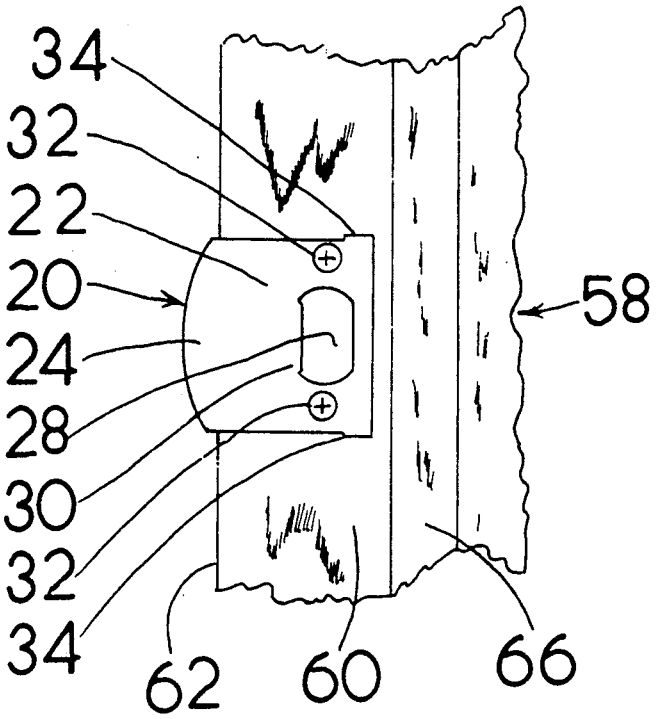
Figure 11:
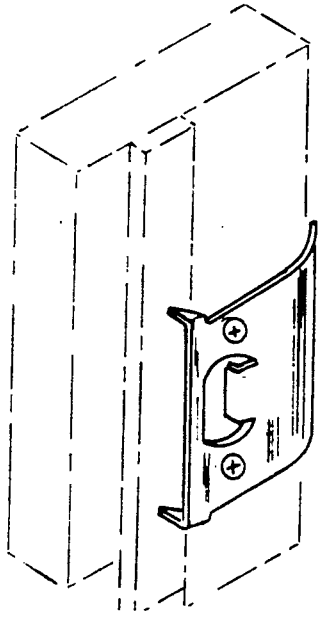
FIG. 11 is a perspective view of the strike plate in the position it would occupy on a door jamb shown in broken lines for illustrating purposes only.
Figure 16:
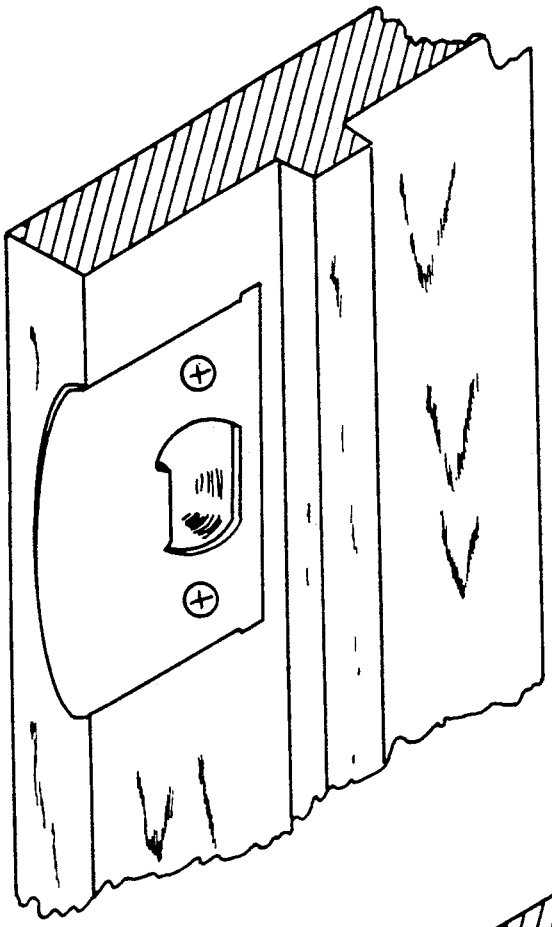
FIG. 16 is a perspective view of my preferred embodiment finish mounted on a door jamb.

The strike plates with screw holes but WITHOUT the relief slots 42 in FIGS. 1, 2, and 4 are finish mounted in FIGS. 8,16, and 11.

Figure 3:
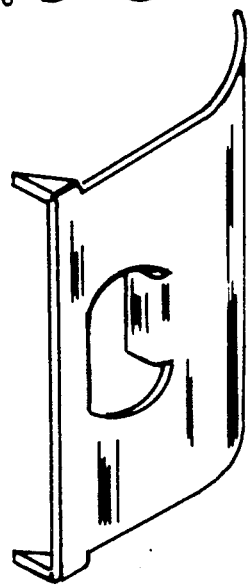
FIG. 3 is a perspective view of my preferred embodiment incorporating an alternative mounting design that omits the screws.

The strike plates WITHOUT screw holes and WITHOUT relief slots is in FIG. 3. The strike plates are finish mounted in FIGS. 9 and 17.

Figure 14:
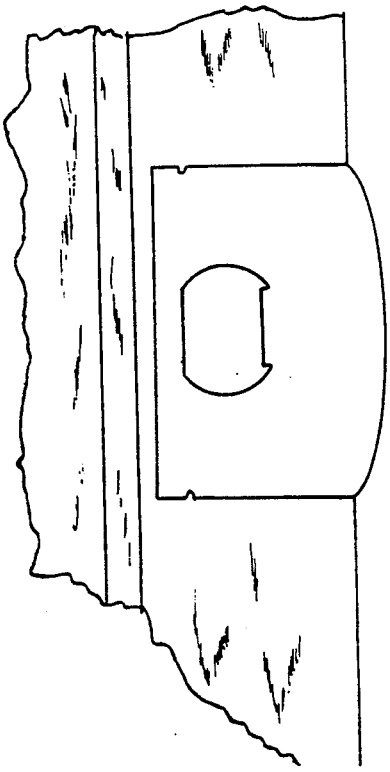
FIG. 14 is a side elevation view of my preferred embodiment with the alternate mounting design using no screws finished mounted on a door jamb illustrating the relief notches at the base of the anchor teeth.

The strike plates with relief slots 42 and WITHOUT screw holes is finish mounted in FIG. 14.

Figure 12:
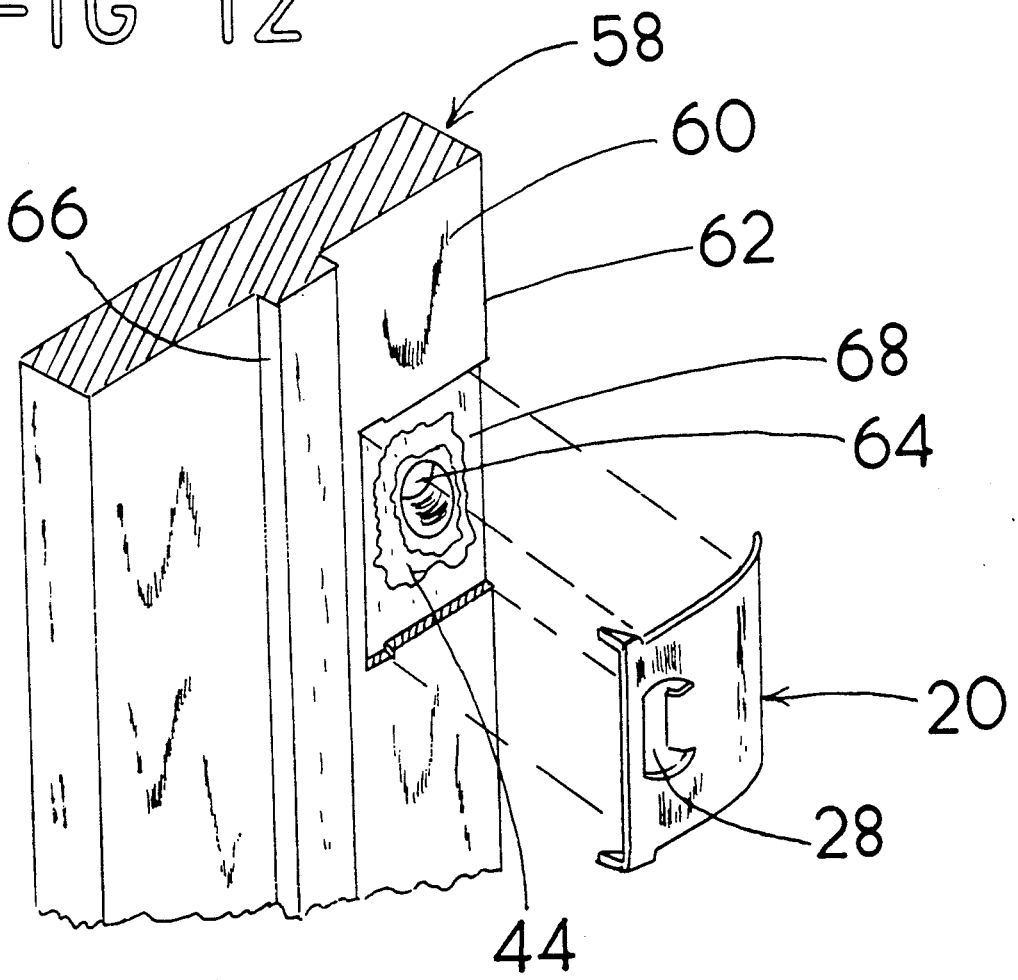
FIG. 12 is an unmounted perspective view of my preferred embodiment illustrating the alternate mounting design that requires no screws for mounting.
Figure 17:
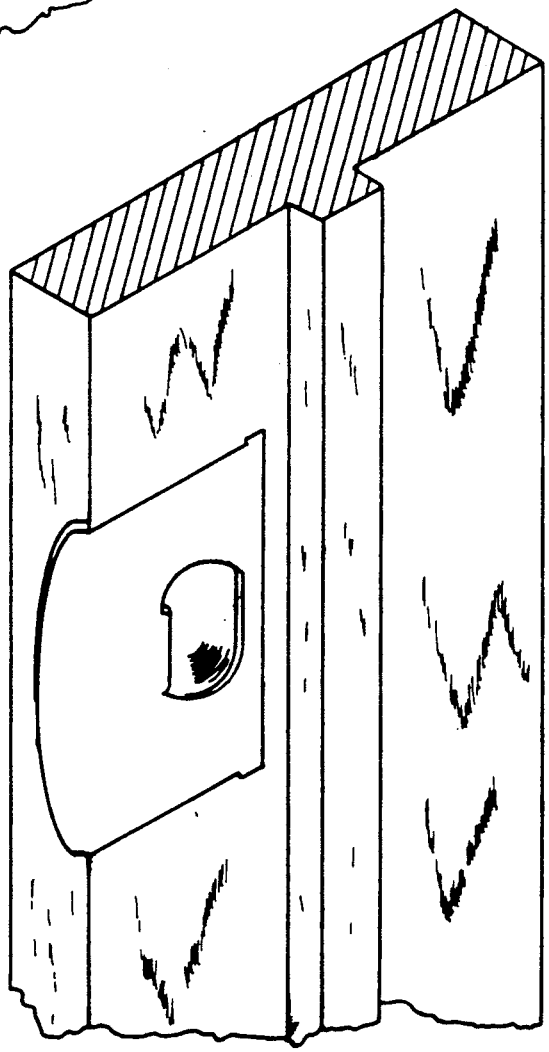
FIG. 17 is a perspective view of my preferred embodiment incorporating the alternative mounting no screw design that is finish mounted on a door jamb.

The strike plates WITHOUT screws for finish mounting use an alternative mounting. An adhesive 44 in the mortise 68 of FIG. 12. Alternative final mounting is illustrated in FIGS. 12, 14, and 17. Both designs use an adhesive for final mounting.

OPERATION of DEVICE

FIGS. 7 and 10 is a plan view of my preferred embodiment in its finished mounting. An installation procedure is followed.

For comparison I will first install a present day common strike plate on a new installed door jamb 58.

Check the new door jamb 58 for being square, plumb, and secured.

To accurately locate the position on the door jamb 58 for the latch bolt hole 64 is a critical need for all strike plates in this field.

Close the door 46 touching the latch bolt 54 against the leading edge 62 of door jamb 58.

Scribe a center line mark of the latch bolt 54 on the leading edge 62 of the door jamb 58.

Open the door 46. Place the tool called a trisquare on the center line mark and scribe a level horizontle line across the face 60 of the door jamb 58. This will be the first reference line for locating the position of the latch bolt hole 64.

Close the door 46. Hold firm against door stop 66. Using the center line mark on the leading edge 62 of the door jamb 58, continue inserting the center of ruler of trisquare on this center line mark untill it butts against the latch bolt 54.

Loosen nut on trisquare base. Slide base along ruler until it rests firmly on door jamb's leading edge 62.

Tighten nut on trisquare while firm against latch bolt 54 and door jamb leading edge 62.

Notice measurement on trisquare. This is the distance between leading jamb edge 62 and latch bolt 54.

Open the door 46. Place the trisquare back on door jamb face 60. Split the ruler on the prior inscribed horizontal reference line. Scribe a vertical line beside the butt end of ruler across the prior horizontal line.

Measure the cross section of latch bolt 54. Place a second vertical line across the horizontal line. The distance between the two vertical lines must equal the size of the cross section of the latch bolt 54.

Locate the center of the two vertical lines crossing the horizontal line.

CRITICAL: This is the exact center for drilling the latch bolt hole 64 into door jamb 60 for accurate latch bolt alignment.

Match the strike plate bolt hole 28 over latch bolt hole 64 in door jamb 60. While holding strike plate, close the door 46 and test latch bolt alignment.

CRITICAL: Decide position of strike plate and hold firmly.

Carefully open door 46 and scribe around strike plate on to door jamb face 60.

Mortise out the thickness of strike plate.

Position strike plate in mortised area 68. Retest alignment by closing door 46.

Open the door 46.

Finish mount the strike plate with accompanying screws 32.

If this strike plate had to be moved to re-align the latch bolt 54 to engage through bolt hole 64 in door jamb 60, this is where more time, work, and frustration comes in for the installer.

It is difficult to reinstall plate in small distances. Misalignment factors are:

Strike plate moved while initially installed
Door warped on door jamb
Weatherstripping later on added
House settling
Earthquake shifting This is where the need becomes evident for a strike plate to easily anchor itself to allow testing of latch bolt alignment. Must easily be removed and repositioned. Must be able to anchor that position while installing final mounting screws.

Here is the procedure for installation of my improved strike plate without the option tang 30 attached.

Check the door jamb as mentioned earlier.

Use the same procedure as mentioned earlier to locate the center to drill the latch bolt hole 64. Again this is a CRITICAL NEED for all strike plates.

Briefly this procedure is:

Locate and scribe center line on door jamb edge 62 with a trisquare at center, scribe a level horizontal line across door jamb face 60.

Locate and scribe the two vertical lines crossing the horizontal line. Place the improved strike plate 20 with the optional tang 30 removed with its latch bolt hole 28 centered on the center of the reference lines on door jamb face 60.

With a smooth face hammer gently tap with alternating blows on the face of the strike plate base 22 and anchor tooth base 36 until strike is tight against door jamb face 60.

Test the latch bolt 54 alignment with bolt hole 28 in strike plate 20.

If latch bolt 54 engages bolt hole 28 on strike plate 20, scribe around strike plate on to door jamb face 60.

Pry off strike plate. Mark anchor tooth 34 indentions.

Drill on center for latch bolt hole 64. Mortise out strike plate thickness. Reinstall strike plate to retest alignment. Finish mount the strike plate with screws 32 into mounting holes 26. FIGS. 8, 11, 13, and 16.

Here is the procedure to install my improved strike plate with the tang 30 attached and screw mount holes 26 in FIGS. 1-6 and FIG. 15.

Check the door jamb as mentioned.

Use the same procedure as mentioned earlier to locate the latch bolt hole center 64.

Briefly the procedure is:

Locate and scribe center line on door jamb leading edge 62. With a trisquare at center scribe a level horizontal line across door jamb face 60.

Locate and scribe the two vertical lines crossing the horizontal line. Locate the center between the vertical lines.

Drill latch bolt hole 64 in door jamb face 60.

Place the improved strike plate 20 with optional tang 30 attached and the screw mounting holes 26 over the latch bolt hole 64.

With a smooth face hammer gently tap with alternating blows on the face of the strike plate base 22 and anchor tooth base 36 until strike plate 20 is tight against door jamb face 60.

Test the latch bolt 54 alignment with bolt hole 28 in strike plate 20. If latch bolt 54 engages bolt hole 28 on strike plate 20 on door jamb 60, scribe around strike plate 20 on to door jamb face 60.

Pry off strike plate 20. Mark anchor tooth 34 indentions, for reference on reinstalling.

Mortise out strike plate thickness.

Reinstall the strike plate and retest alignment.

Finish mount the strike plate 20 with screws 32 into mounting holes 26 in FIGS. 8,11,13, and 16.

Here is the procedure to install my improved strike plate 20 with the tang 30 attached and final mounting WITHOUT screws in FIGS. 3, 14 and 17.

This strike plate is not for entry doors security.

This strike plate is designed for interior hollow core passage doors in residential and apartment complexs; bathrooms, bedrooms and walk in closets.

Briefly the procedure is;

Check the door jamb as mentioned and to locate latch bolt hole 64 use procedure as mentioned earlier.

Locate and scribe center line on door jamb leading edge 62. With a trisquare at center scribe a level horizontal line across door jamb face 60.

Locate and scribe the two vertical lines crossing horizontal line on jamb face 60. Mark the center between vertical lines.

Drill latch bolt hole 64 in door jamb face 60.

Place the improved strike plate 20 with optional tang 30 attached and no screw mounting holes over the latch bolt hole 64 in FIG. 12.

With a smooth face hammer gently tap with alternating blows on the face of the strike plate base 22 and anchor tooth base 36 until strike plate 20 is tight against door jamb face 60.

Test the latch bolt 54 alignment with bolt hole 28 in strike plate.

If latch bolt 54 engages bolt hole 28 on strike plate and door jamb, scribe around strike plate on to door jamb 60.

Pry off strike plate 20. Mark anchor tooth 34 indentions for reference on reinstalling.

Mortise out strike plate thickness. Reinstall the strike plate and retest alignment. Pry off strike plate and apply silicone cauking 44 around mortised area 68.

Finish mount the strike plate by reinstalling on to silicone coated mortise 68.

Wipe off excess silicone around strike plate. Illustrated in FIGS. 9,12,14, and 17.

Procedure for replacing an existing common strike plate with my improved strike plate 20.

Remove existing strike plate by removing its mounting screws.

Position my improved strike plate 20 over latch bolt hole 64 in existing mortised area 68.

With a smooth face hammer gently tap with alternating blows on the face of the strike plate base 22 and anchor tooth base 36 until strike plate 20 is tight against door jamb face 60.

Close door to test latch bolt 54 alignment with new strike plate 20.

If latch bolt 54 engages latch bolt hole 28 on strike plate 20 insert finish mounting screws 32 into mounting holes 26.

SUMMARY, RAMIFICATIONS, AND SCOPE

Thus the reader will see that this strike plate with its removable preliminary self attaching anchor teeth has a unique function that aids the installer in setting, testing, and holding latch bolt alignment accuracy, which is a critical requirement for strike plates.

Particularly it should be apparent to those skilled in this art that I have provided a simple, inexpensive, and effective design whose built in function is to aid the installer. Faster finish mounting by the skilled installer. The semi-skilled and home owner with simple tools, some mechanical and physical ability using this will have more command over mounting procedure resulting in easier and neater installation.

Furthermore this strike plate has the additional advantages in that:

- Economical and simple one unit design
- Door jamb preparation is the same
- Works on all door sizes and types
- No special skill by installer
- No special tools required
- Easily attached
- Easily removed by prying off
- Holds its position so final mounting screws are installed
- Option of an alternative final mounting adhesive Anchor teeth are removable Although the description above contains many specificities, these should not be construed as limiting the scope of this invention but as merely providing illustrations of some of the presently preferred embodiments of this invention.

The strike plate and keeper plate that incorporate the self attaching function by the use of anchor teeth are not limited to a specified number of teeth on the plate nor position where located on the plate nor shape and size of the anchor tooth.

The self attaching function can be applied to other strike plates, security plates, adjustable plates, strike boxes, hinges, hasps, support brackets for door closure, entry door knobs, door handles, and any door hardware.

The strike plate can be designed with relief slots anywhere for effective tooth removal and to keep anchor tooth surface in edge alignment.

This strike plate with the self attaching function has many choices of adhesive final mounting in its option for alternate no screw final mounting.

A surface protective tape could be applied on the surface of the strike plates and peeled off after installation.

Thus the scope of the invention should be determined by the appended claims and their legal equivalents, rather than by the examples given.

I claim:

1. Removable anchor teeth for self attaching fasteners comprising:

a strike plate of rectangular design, a number of tapered extensions interconnected with said strike plate and of a design that will penetrate wood, a laterally scored line on said base of said tapered extensions that upon repeated bending can sever the distal portion of said tapered extensions.

2. The improved said anchor teeth of said claim 1 wherein the mounting provides the means to adjust said fastner laterally in unspecified increments for corrected positioning of said mounting on a door jamb.

3. The said improved anchor teeth of said claim 1 wherein said strike plate contains screw mounting holes.

* * * * *